US005653281A

United States Patent [19]

Berg et al.

[11] Patent Number: 5,653,281

[45] Date of Patent: Aug. 5, 1997

[54] STEAM CONDENSING MODULE WITH INTEGRAL, STACKED VENT CONDENSER

[75] Inventors: John Lawrence Berg, Houston; George Edward Kluppel, Richmond, both of Tex.; William Joseph Oberjohn, Washington Township, Start County; Thomas Wayne Strock, Jackson Township, Stark County, both of Ohio

[73] Assignee: Hudson Products Corporation, Houston, Tex.

[21] Appl. No.: 575,927

[22] Filed: Dec. 20, 1995

[51] Int. Cl.[6] ..... E28B 1/06; E28B 9/10

[52] U.S. Cl. ..... 165/113; 165/111; 165/DIG. 193; 165/DIG. 222; 165/146

[58] Field of Search ..... 165/111, 112, 165/113, DIG. 193, DIG. 222, 146

[56] References Cited

U.S. PATENT DOCUMENTS 4,177,859 12/1979 Gatti et al. ..... 165/11
4,190,102 2/1980 Gerz ..... 165/113

FOREIGN PATENT DOCUMENTS 10770 4/1908 Denmark ..... 165/111

*Primary Examiner*—Allen J. Flanigan
*Attorney, Agent, or Firm*—Robert J. Edwards; Michael L. Hoelter

[57] ABSTRACT

An air-cooled steam condensing module with an integral vent condenser has a steam header, one or more rows of condensing tubes between the steam header and a (generally lower) common condensate header. The module also has at least one row of vent condenser or dephlegmator tubes located adjacent the condensing tubes which connect the lower header to a vent header. The dephlegmator tubes may be of the same or larger diameter than the condensing tubes.

15 Claims, 2 Drawing Sheets

STEAM CONDENSING MODULE WITH INTEGRAL, STACKED VENT CONDENSER

FIELD OF THE INVENTION

This invention pertains to heat transfer equipment in general and more particularly to air-cooled vacuum steam condensers for heat exchange purposes.

BACKGROUND OF THE INVENTION

Steam condensers are used in the electric power industry to provide the heat rejection segment of their thermodynamic Rankine power cycle. To accomplish this, steam condensers are coupled to the exhaust of low pressure turbines so as to condense this exhausted steam to liquid and return it for reuse in the power cycle. The primary function of the steam condenser is to provide a low back-pressure at the turbine exhaust, typically between 1.0 and 6.0 inches Hg absolute. Maintaining a low back-pressure maximizes the power plant thermal efficiency.

The two primary types of steam condensers are water-cooled surface condensers and air-cooled condensers. Water-cooled surface condensers are the dominant technology in modern power plants. However, air-cooled steam condensers are being used more frequently in order to comply with strict environmental requirements.

Air-cooled steam condensers have been used since the 1930's. The primary technical challenges that exist today regarding such condensers are with respect to the approach used to efficiently drain the condensate and the manner of trapping and removing noncondensable gas (typically air which has leaked into the system) while minimizing the turbine back-pressure. These air-cooled steam condensers are typically arranged in an A-frame construction with a fan horizontally disposed at the base and separate condenser tube modules inclined thereabove through which air flows. The steam inlet to these condenser tube modules is located at the top or apex so that the vapor and any resulting condensate both flow concurrently downward within the module.

Each module of a typical air-cooled steam condenser is generally composed of four or so rows of tubes stacked therein. As air flows upward around these stacked rows, its temperature increases resulting in a corresponding decrease in temperature difference between such air and the steam inside the next tube row. This lower temperature difference for each successive tube row results in less vapor flow and condensation occurring with respect to that tube row. Since the condensate and steam flows are lower for each successive tube row, the two-phase flow pressure drop is also lower for each successive tube row.

For a simple condenser, all the tube rows discharge into a common lower header that is at a pressure equal to the highest (fourth or uppermost tube row) exit pressure. Consequently, steam and noncondensable gases in the common lower header enter the discharge ends of these first three tube rows. With steam vapor now entering both ends of a tube, noncondensable gases (air) become trapped therein. It is in these air pockets that the condensate freezes during cold weather. Also, these air pockets blanket the heat transfer surface area thereby reducing the condenser efficiency during hot weather. Noncondensable gases that do not become trapped are generally vented from the lower header with vacuum pumps or ejectors.

The ideal solution to the steam condenser problem is to maintain complete separation of fluid streams exiting each tube row. This is the fundamental approach of the steam condenser in U.S. Pat. No 4,129,180. Rather than a common lower header, this patent discloses a divided lower header with separate condensate and vent lines for each division of this lower header. With such independent lines, there is no pressure cross-over between the various tube rows. Condensate lines from each division of the lower header flow to a common drain pot that is configured with a water leg seal to balance the different pressures between them. The vent lines from each division of the lower header are also routed independently to individual vacuum pumps or ejectors for eventual discharge to the atmosphere. While this approach is ideal, manufacturing and erection costs are higher due to the complex system of drain lines and vent piping.

An alternate design that is commonly used is a two-stage condenser. In the main condenser, steam and condensate flow concurrently downward together through approximately two-thirds of the heat exchanger surface area required to condense the steam. Since the surface area of the main condenser is inadequate for complete condensation, excess steam from each of the rows is permitted to flow into the main condenser's common lower header. This prevents any backflow of steam and noncondensable gases back into these tube rows.

This excess steam then flows to a separate secondary condenser, typically a dephlegmator, that comprises the remainder (approximately one-third) of the total condenser surface area. Such a dephlegmator is constructed similar to the main condenser with each bundle thereof incorporating multiple (usually four or so) vertically stacked tube rows therein. In the dephlegmator, however, this excess steam and noncondensable gases flow upward in these tube rows from a lower common header before the gas therein is discharged. The resulting condensate from this upwardly flowing excess steam flow stream, however, flows by gravity countercurrently downward back to the common lower header supplying these tube rows. This common lower header thus both supplies these tube rows with the excess steam and noncondensable gases as well as collects the condensate from these tube rows.

Such a separate vent condenser (or dephlegmator) downstream the main condenser is designed to prevent the main condenser from trapping any noncondensable gases therein. However, should the vent condenser itself comprise multiple rows (which is normally the case), such a vent condenser will, in turn, experience backflow in its own lower tube rows. Thus, this problem of trapping noncondensable gases due to the backflow of steam into lower rows will merely be shifted to the vent condenser from the main condenser.

U.S. Pat. No. 4,177,859 discloses an air cooled steam condenser whose lower header is baffled. This lower header also incorporates a separate inspection well that collects the condensate from the first or lowermost row of tubes which fully condenses the steam flowing therethrough. This inspection well is used to check the temperature of the condensate from this first row of tubes. However, this patent does not disclose how to prevent freezing should the condensate in the inspection well approach freezing temperatures. Nor does this patent discuss the elimination of backflow into the tubes so as to avoid the accumulation of noncondensable gases.

Other alternate design solutions involve fixed orifices or flapper valves to equalize the pressure drop between tube rows. Still other designs may vary tube fin spacing, fin height, or fin length from row to row in an attempt to achieve a balanced steam pressure drop. Another novel solution, described in U.S. Pat. No. 4,513,813, arranges tubes horizontally with multiple passes. In this arrangement, the flow through each tube experiences a similar cooling potential and therefore has a similar condensation rate and pressure drop. However, all of these alternate solutions either perform well only at the steam condenser design operating condition and/or are not cost competitive.

An important design limitation for the integral vent condenser is the counter current flow limit steam vapor velocity. At this critical velocity, steam entering the vent condenser is at a sufficient velocity to force the counter flowing condensate (which flows by gravity) to flow upward or backup into the vent condenser thereby preventing it from draining. This liquid backflow now being trapped greatly increases the vent condenser pressure drop and thus reduces the efficiency of the air removal system as well as increases the turbine back pressure.

It is thus an object of this invention to provide an air cooled condenser having a lower cost of maintenance and construction than prior airflow condensers which are known. A further object of the invention is to substantially eliminate the accumulation of noncondensable gases in the various tube rows of the heat exchanger. Another object of this invention is to substantially eliminate freezing of condensate in the condensing tubes by stacking the vent condenser over the main condenser such that the two are incorporated or integrated into a single module rather than as separate but adjacent modules. Yet another object of this invention is to locate the vent condenser in a region where the air temperature will have been heated above the freezing point of water. An additional objective of the invention is to prevent noncondensable gas accumulation by having a constant flow of vapor out of all main condenser tube rows in order to purge them of any such gases on a continual basis. Yet another object of the invention is to provide a design for the inlet configuration of the dephlegmator so as to increase the counter current flow limit value thereby increasing the capacity and flow rate permitted for the heat exchanger.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

SUMMARY OF THE INVENTION

This invention pertains to an air cooled steam condenser module having an integral vent condenser. This steam condenser incorporates a steam header that is designed to supply steam to at leapt one row of elongated condensing tubes that are coupled thereto. A common condensate header is spaced from the steam header with this separate condensate header being coupled to a second opposite end region of the condensing tubes. A portion of the steam passing through the condensing tubes is condensed with the remaining uncondensed or excess steam portion continuously flowing through the condensing tubes and into the common condensate header. This condensate header is configured with no baffles or compartments therein which would otherwise separate or divide the rows of the condensing tubes. At least one row of vent condenser tubes are positioned integral with the row(s) of condensing tubes with each of these vent condenser tubes having a bottom end region that is coupled to the condensate header. These vent condenser tubes are generally oriented parallel to the condensing tubes with the uncondensed or excess steam portion passing through these vent condenser tubes for the complete condensation thereof. A vent header is connected to an upper region of the vent condenser tubes and means are provided for supplying cooling air to the condensing module.

DESCRIPTION OF THE PREFERRED EMBODIMENTS

Figure 1:
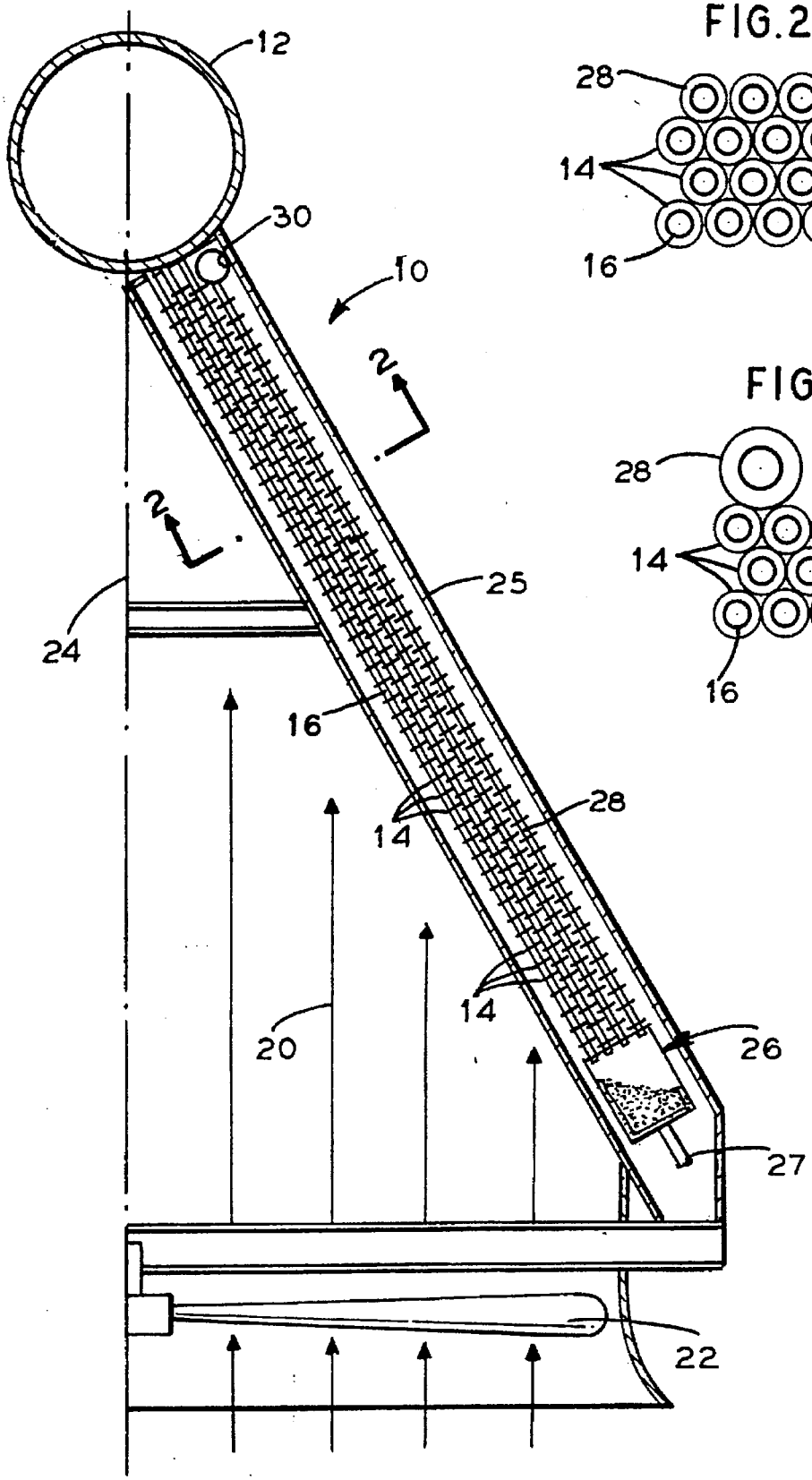
FIG. 1 is a pictorial view illustrating the internal components of the invention.
Figure 2:
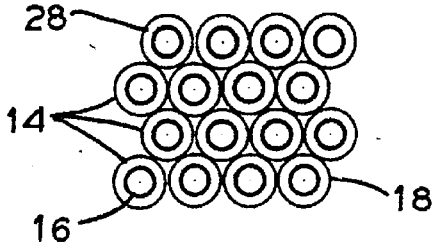
FIG. 2 is a sectional view taken along lines 2—2 of FIG. 1 illustrating the arrangement of the tubes within the condenser.
Figure 3:
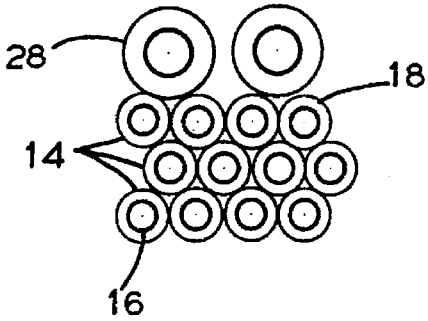
FIG. 3 is an illustration of an alternative arrangement of the tubes as shown in FIG. 2

Referring initially to FIGS. 1–3, there is shown an air-cooled condenser or heat exchanger 10. In this embodiment, steam is supplied to an upper steam header 12 of heat exchanger 10. Steam header 12, in turn is coupled to a main condenser which comprises a plurality of tube rows 14. While FIG. 1 discloses three such tube rows 14 receiving steam from header 12, there can be more or fewer such rows 14 if desired. Each tube 16 in each tube row 14 is generally configured with a series of spaced fins 18 secured thereto. These fins 18 enhance the heat exchange between the tube 16 and the upwardly flowing air 20 passing through tube rows 14 as forced by fan 22. In other embodiments, such air flow can occur naturally without the necessity of being forced thereby potentially eliminating the need for fan 22.

FIG. 1 illustrates only one side of heat exchanger 10 cut along a vertical plane intersecting centerline 24, the other side would be a mirror image of that shown. Also, heat exchanger 10 would generally be constructed of a plurality of adjacent modules 25 each having a cross-section similar to that shown. These various modules 25 would be interconnected with each other by steam header 12 and common condensate header 26 in a parallel relationship such that there would be little or no pressure difference between or among the various modules 25. The actual number of modules 25 required for condenser 10 is determined by the volume of steam flow into steam header 12 and the desired back-pressure value to occur at the turbine exhaust (not shown but which is coupled to steam header 12).

In the drawings, condensate header 26 is configured as being of the common type in that it is not compartmented or baffled which would otherwise separate or divide the various tube rows 14. Header 26 is also shown as being below or underneath steam header 12, but this need not always be the case. In any event, the steam flowing through tube rows 14 is not fully condensed at all operating conditions before it enters lower condensate header 26. Because excess steam now continuously flows from each tube row 14, the pressure between such rows 14 is equalized in lower header 26. This continuous purging of rows 14 insures that no backflow into tube rows 14 from lower header 26 will occur. If such were to occur, air would become trapped therein, which could lead to freezing of the condensate, and the rupture of one or more tubes 16.

While lower condensate header 26 is shown as being rectangular in shape, other configurations are also likely. Also, the manner of securing condensate header 26 to the various tube rows 14 and also to heat exchanger 10 can vary as needed or desired. Furthermore, by interconnecting the condensate headers 26 from the various modules 25 of heat exchanger 10, only a single or a low number of condensate drain lines 27 need be employed.

As shown in FIG. 1, integral upper tube row or vent condenser 28 is oriented generally parallel to tube rows 14, but this upper row 28 serves as a vent condenser which both vents noncondensable gases and condenses the excess steam entering condensate header 26. Because of the upward flow of the uncondensed excess steam through upper row 28 from lower header 26, any resulting condensate will flow downward against such steam flow. Thus, it is important that the volume or velocity of such steam flow should not be so great as to trap or entrain this condensate within upper row 28. Basically, heat exchanger 10 operates by insuring excess steam flow through tube rows 14 of the main condenser with complete condensation occurring in integral tube row 28 of the vent condenser. With this configuration, there is no need to supply the excess steam to a separate condenser or dephlegmator as was previously required. Instead, each module 25 now incorporates its own vent condenser tube rows 28.

FIG. 2 illustrates a typical arrangement of condensing tube rows 14 and upper vent tube row 28. In this arrangement, the size of the various tubes 16 are all the same. However, as shown in FIG. 3, the size of the tubes in upper row 28 can be made larger than the tubes in tube rows 14 of the main condenser. Such larger tube sizes for upper tube row 28 will result in a slower steam velocity through this tube row 28 thereby reducing the chance that any condensate will be held or trapped within such row 28. Freeze protection can also be provided by adjusting fan power or blade pitch in order to change air flow 20. The actual amount of control required is dependent on the condenser pressure among other variables.

In fact, an important design limitation for integral vent condenser tube row 28 is the counter-current flow limit (CCFL) steam vapor velocity. At this critical velocity, the steam entering upper row 28 is at a sufficient velocity to prevent the condensate therein from flowing downward back toward header 26. This condition increases the pressure drop across the vent condenser (i.e. tube rows 28) thereby reducing the efficiency of condenser 10. It also increases the turbine back-pressure which is undesirable.

However, to avoid such an occurrence, the tube sizing shown in FIG. 3 can be implemented. These upper tubes 28 will not only incorporate fins thereon to increase their cooling capacity, but will also be larger in size than tubes 16 in tube rows 14. These larger tubes 28 will each have a surface area greater than the surface area of tubes 14 in the main condenser (in proportion to the ratio of their diameters). Additionally, each larger tube 28 will also have a flow area greater than the flow area of tubes 16 (in proportion to the ratio of their diameters squared). Hence, the steam velocity through upper row 28 will be reduced.

FIG. 3 also illustrates that each tube row 14 of the main condenser is composed of tubes 16 which all have the same diameter. This need not necessarily be the case since it is also possible for one of these tube rows 14 to be comprised of tubes 16 having a diameter different from that of the other adjacent tube rows 14. For example, while the two bottommost rows may consist of tubes 16 having a diameter of about 2 inches OD, the next higher row 14 may have tubes 16 with a diameter of about 1.5 inches OD. Also, the upper or vent condenser row 28 may comprise tubes 16 having a diameter of about 2 inches OD. This reduction in diameter of the second tube row 14 aids in reducing the necessary venting capacity of vent condenser tube row 28.

Located at the exit end of upper vent condenser row 28 is pipe 30 (generally horizontally aligned) which receives the noncondensable remainder of the flow through upper row 28. This pipe 30 transports such noncondensable gas to an air removal system (not shown) thereby venting any noncondensable gases entrained in the steam supplied to header 12 or leaked into heat exchanger 10. It is also possible to provide further freeze protection by locating air removal pipe 30 within steam header 12 if need be.

FIG. 1 illustrates tube row 28 of the vent condenser as being stacked above tube rows 14 of main condenser. However, if desired, these vent condenser tube rows 28 can be located within or between such tube rows 14 of the main condenser. Thus, while FIG. 1 illustrates fan air flow 20 first passing over tube rows 14 before reaching upper row 28, this can be altered. In other words, heat exchanger 10 can be configured so that air 20 will flow past, say, two rows of main condenser tubes 14, then over row 28 of vent condenser, and finally over the last row or rows 14 of the main condenser. In any event, integral vent condenser tube row 28 is located where the temperature of the air flowing therethrough is above freezing, such air 20 being heated by the prior passage through tubes 14 of the main condenser.

One main advantage of heat exchanger 10 is the simplicity of the removal of the condensate from condensate header 26 and the air and noncondensable gases from piping 30. This significantly reduces the cost relative to designs that incorporate individual condensate drains and air removal piping for each tube row. Also, by placing vent condenser tube row 28 adjacent or within tube rows 14 of the main condenser as described, this vent condenser tube row 28 is freeze protected and there is no likelihood of any localized backflow into tube rows 14. Also, by incorporating main condenser tubes 14 and vent condenser tubes 28 within the same module 25, savings are realized since separate components are no longer required nor is there a need to deliver excess steam between them.

While the embodiment shown herein incorporates three tube rows 14 in the main condenser, more or fewer such rows may actually be employed (and the diameter of the individual tubes 16 therein may vary) depending on the conditions that must be met. Also, the number and diameter of vent tube row 28 may also vary as needed. Furthermore, it is possible to vary the width, length, and depth of the various components of condenser 10 in order to accommodate the user's requirements. Additionally, the tube diameter, wall thickness, material of construction, and heat transfer characteristics of fins 18 or of the various tubes and/or tube rows 14, 16, and 28 can be constructed to a great many specifications without departing from this invention.

Figure 4:
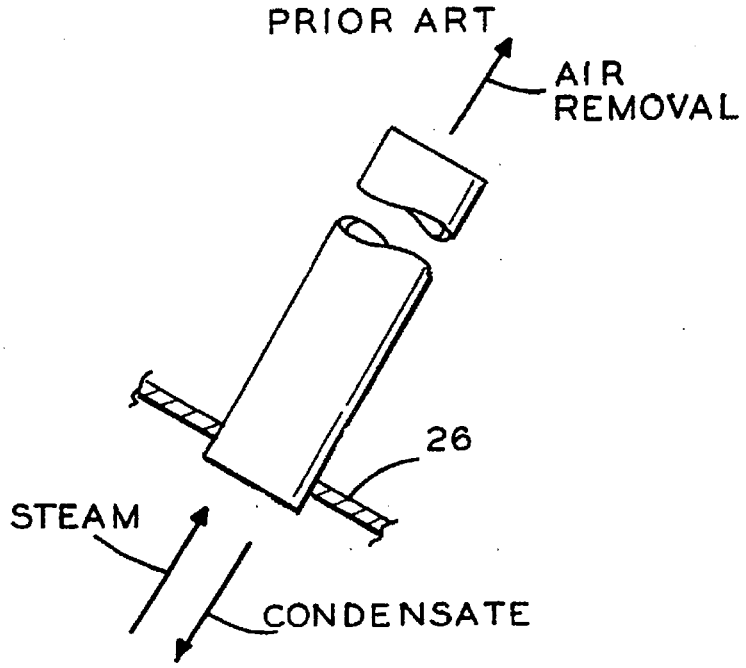
FIG.4 PRIOR ART
FIG. 4 is pictorial view of a typical entrance opening of a tube in a dephlegmator.
Figure 5:
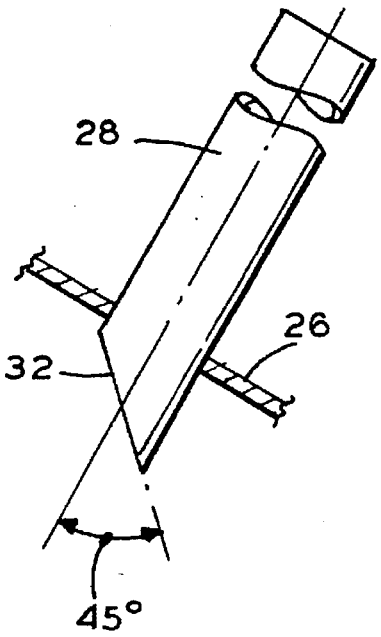
FIG. 5 is a pictorial view of an oblique-cut dephlegmator tube inlet.
Figure 6:
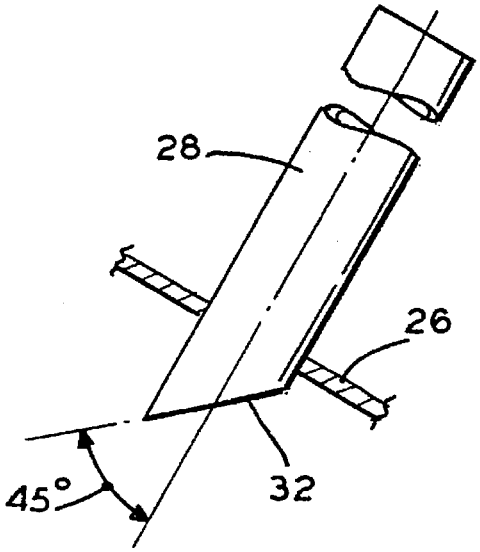
FIG. 6 is a pictorial view of another version of an oblique-cut dephlegmator tube inlet.

A further embodiment of heat exchanger 10, and more particularly tube row 28, is shown in FIGS. 4–6. In this embodiment, the ends of each tube in tube row 28 which are coupled to lower header 26 are not straight cut as shown in FIG. 4, but instead are cut at an angle as shown in FIGS. 5 and 6. In this fashion, a larger opening 32 into each of the tubes of vent condenser tube row 28 is accomplished without increasing the overall diameter of the individual tubes. This greater opening 32 results in a larger CCFL value thereby enabling heat exchanger 10 to operate under greater load conditions. Thus, regardless of the size or diameter of vent condenser tube row 28, the counter-current flow limit is maximized by the oblique angle of opening 32. By cutting opening 32 at an oblique angle rather than a more typical perpendicular angle as shown in FIG. 4, the steam velocity into opening 32 is reduced. Hence, the overall steam flow rate can be increased until a new higher counter-current flow limit is reached.

As can be imagined, at the entrance to tube row 28 of the vent condenser located within lower header 26, the excess steam and condensate velocities are at their maximum since condensation of the excess steam occurs downstream of such entrance. Also, at this entrance, the internal flow separation caused by the excess steam entering the normal straight-cut tube reduces the effective flow area. However, by configuring the entrance to vent condenser tube row 28 such as shown in FIGS. 5 and 6, the inlet flow area is increased which reduces the steam velocity into the tube at opening 32. Such a slant cut opening 32 also increases the CCFL value thereby allowing a faster rate of excess steam flow before the counter-flowing condensate becomes trapped within tube row 28 of the vent condenser.

While FIGS. 5 and 6 disclose a slanted opening 32 having an angle of 45°, an opening configured at other angles will also result in the improvements described above.

What is claimed is:

1. An air cooled steam condenser module with integral vent condenser comprising:

(a) at least one row of elongated condensing tubes having a first end region coupled to a steam header for the passage of stem therethrough;

(b) a common condensate header spaced from said steam header and coupled to a second opposite end region of said condensing tubes, said stem passing through said condensing tubes being partially condensed therein with the remaining uncondensed excess stem portion continuously flowing through said condensing tubes and into said common condensate header, said common condensate header being configured with no baffles or compartments therein which separate or divide the said rows of said condensing tubes;

(c) at least one row of vent condenser tubes positioned adjacent and generally parallel to said condensing tubes within the condenser module, said vent condenser tubes having a bottom end region coupled to said common condensate header for the passage therethrough of said uncondensed excess steam for the complete condensation thereof, said bottom end region of said vent condenser tubes being slant-cut or tapered thereby forming an angle with respect to the longitudinal axis of said vent condenser tubes;

(d) a vent header connected to an upper region of said vent condenser tubes; and (e) means for passing cooling air through the condenser module.

2. An air cooled steam condenser module as set forth in claim 1 wherein said bottom end region of said vent condenser tubes are cut at an angle of 450° with respect to the longitudinal axis of said tubes.

3. An air cooled steam condenser module as set forth in claim 2 wherein said common condensate header is below or underneath said steam header.

4. An air cooled steam condenser module as set forth in claim 3 wherein a plurality of such modules are connected together in a parallel relationship via said steam header and said common condensate header.

5. An air cooled steam condenser module as set forth in claim 3 further comprising three rows of said condensing tubes and one row of said vent condenser tubes in the condenser module.

6. An air cooled steam condenser module as set forth in claim 3 wherein said row of vent condenser tubes is located above said rows of condensing tubes.

7. An air cooled steam condenser module as set forth in claim 3 wherein said row of vent condenser tubes is located intermediate to said rows of condensing tubes.

8. An air cooled steam condenser module as set forth in claim 3 wherein the diameter of said vent condenser tubes is equal to the largest diameter of said condensing tubes.

9. An air cooled steam condenser module as set forth in claim 3 wherein the diameter of said vent condenser tubes are larger than the diameter of said condensing tubes.

10. An air cooled steam condenser module as set forth in claim 9 wherein the diameter of said vent condenser tubes is twice the diameter of said condensing tubes.

11. An air cooled steam condenser module as set forth in claim 3 further comprising a condensate drain connected to said common condensate header, said drain being sized to remove any collected condensate from said common condensate header.

12. An air cooled steam condenser module as set forth in claim 11 wherein said vent header extends generally parallel with said steam header.

13. An air cooled steam condenser module as set forth in claim 12 wherein said vent header extends external to said steam header.

14. An air cooled steam condenser module as set forth in claim 13 wherein said vent header extends within said steam header.

15. An air cooled steam condenser module with integral vent condenser comprising:

(a) at least one row of elongated condensing tubes having a first end region coupled to a stem header for the passage of steam therethrough;

(b) a common condensate header spaced from said steam header and coupled to a second opposite end region of said condensing tubes, said steam passing through said condensing tubes being partially condensed therein with the remaining uncondensed excess steam portion continuously flowing through said condensing tubes and into said common condensate header, said common condensate header being configured with no baffles or compartments therein which separate or divide the said rows of said condensing tubes;

(c) at least one row of vent condenser tubes positioned adjacent and generally parallel to said condensing tubes within the condenser module, said vent condenser tubes having a bottom end region coupled to said common condensate header for the passage therethrough of said uncondensed excess steam for the complete condensation thereof;

(d) a vent header connected to an upper region of said vent condenser tubes;

(e) means for passing cooling air through the condenser module; and (f) said condensing tubes, condensate header, vent condenser tubes and vent header being dimensioned so that steam entering said vent condenser tubes is at a velocity below the critical counter-current flow limit steam vapor velocity for the vent condenser tubes for reducing stem velocity in the vent condenser tubes and allowing condensation formed in the vent condenser tubes to return to the condensate header;

and wherein the vent condenser tubes are dimensioned to have a diameter larger than the diameter of said condensing tubes.

* * * * *